US007510451B2

(12) United States Patent
Inaba

(10) Patent No.: US 7,510,451 B2
(45) Date of Patent: Mar. 31, 2009

(54) WATERCRAFT

(75) Inventor: Koshiro Inaba, Shizuoka-ken (JP)

(73) Assignee: Yamaha Hatsudoki Kabushiki Kaisha (JP)

( * ) Notice: Subject to any disclaimer, the term of this patent is extended or adjusted under 35 U.S.C. 154(b) by 0 days.

(21) Appl. No.: 11/518,518

(22) Filed: Sep. 8, 2006

(65) Prior Publication Data

US 2007/0054571 A1 Mar. 8, 2007

(30) Foreign Application Priority Data

Sep. 8, 2005 (JP) ..... 2005-260056

(51) Int. Cl.
*B63H 20/32* (2006.01)

(52) U.S. Cl. ..... 440/77; 440/88 A; 440/88 C

(58) Field of Classification Search ..... 440/77, 440/88 A, 88 R, 88 C
See application file for complete search history.

(56) References Cited

U.S. PATENT DOCUMENTS 3,964,444 A * 6/1976 Hemmann et al. ..... 123/41.49
4,770,262 A * 9/1988 Yasunaga et al. ..... 180/68.1
4,927,392 A * 5/1990 Makihara et al. ..... 440/88 R
5,078,629 A 1/1992 Mondek
5,129,847 A * 7/1992 Mondek ..... 440/88 R
5,245,954 A * 9/1993 Donohue ..... 123/41.65
5,445,547 A 8/1995 Furukawa
5,660,571 A * 8/1997 Nakayasu et al. ..... 440/88 R
2001/0027069 A1* 10/2001 Mashiko et al. ..... 440/88
2007/0066158 A1* 3/2007 Inaba ..... 440/88 A

FOREIGN PATENT DOCUMENTS

JP 64-8312 * 1/1989
JP 401182192 A 7/1989
JP 2004-239156 8/2004

* cited by examiner

*Primary Examiner*—Stephen Avila
(74) *Attorney, Agent, or Firm*—Knobbe Martens Olson & Bear LLP

(57) ABSTRACT

A watercraft has an outboard motor mounted to a hull and a remotely mounted air intake system. The outboard motor has an engine and an air/fuel mixing device. The air intake system is disposed within the hull and may include one or more filters for removing foreign materials and/or moisture from the intake air. The filtered air is routed via one or more ducts directly to the engine so as to not allow the outboard motor to appreciably heat the air before the air reaches the engine.

19 Claims, 1 Drawing Sheet

WATERCRAFT

RELATED APPLICATIONS

The present application is based on and claims priority under 35 U.S.C. § 119(a)-(d) to Japanese Patent Application No. 2005-260056, filed on Sep. 8, 2005, the entire contents of which is hereby expressly incorporated by reference herein.

BACKGROUND OF THE INVENTION

1. Field of the Invention

The present invention relates to an induction system for a watercraft having an outboard motor.

2. Description of the Related Art

Known outboard motors mix ambient air entering through the engine's cowling with fuel. The air/fuel mixture is burned in one or more cylinders of the motor to generate power and propel the watercraft. The output efficiency of the engine may decline if the air/fuel mixture contains excessive moisture.

Since watercrafts operate in a wet environment, the opportunity exists for water or moisture to be added to the air entering the engine. Accordingly, it is desirable to reduce the chance that water or moisture is in the intake air. If the air includes moisture, it is desirable to remove the moisture from the air before the air is mixed with the fuel.

Patent Document JP-A-2004-239156 discloses a structure which separates moisture from air containing moisture. The specification states, "Air flowing into each side air duct through an ambient air intake formed at the duct passes through an air passage which is bent, on the way to its goal; thereby, the air is compulsively turned sideward. Moisture thus is separated from the air containing the moisture. Further, the air flowing into a downstream intake chamber via a communicating port is compulsively turned to a vertical direction so that again remaining moisture is further separated. The air from which the moisture is separated in the two stages is mixed with fuel." The air flows from lateral sides of the watercraft because the ambient air intakes are located at the respective side air ducts. However, moisture from side waves during turning and from other waves during normal running conditions may still enter the air intakes. The structure further does not prevent raindrops from entering the air intakes. In addition, the downstream intake chamber into which the air flows has a vertically extending chimney-shaped structure. It is difficult to sufficiently block moisture when there is a large amount of moisture or a large water splash.

U.S. Pat. No. 5,078,629 discloses a structure which inhibits moisture from mixing with air. The specification states, "A transom board of the hull has an opening and a cowling of an outboard motor has an air port for taking air for combustion. The opening and the air port are connected to each other through a duct; thereby, air is taken from a location in the hull." "The air hardly contains moisture in comparison with the case in which the cowling of the outboard motor has an intake opening and air is taken through the intake opening." With this structure, air enters through an opening in the transom board. However, if rain falls into the hull or waves enter the hull, moisture may enter the openings in the transom and mix with the air. Further, the structure routes the intake air through the cowling but does not provide a passage to the engine. Thus, the intake air may be warmed before it reaches the motor.

In the air intake structures above, moisture from waves may still mix with the air or the air may be warmed as the air is routed between the transom and the engine.

SUMMARY OF THE INVENTION

In view of the foregoing, a need exists for an induction system that reduces the chance of moisture being mixed with the intake air while not heating up the intake air so as to improve the output efficiency of the outboard motor.

An aspect of the invention is directed to a watercraft. The watercraft includes a hull and an outboard motor mounted to the hull. The outboard motor includes a cowling which houses an engine and an induction system. The watercraft further includes a duct which passes through the cowling. The duct has an inlet and an outlet. The inlet is disposed within the hull. The outlet is connected to the induction system such that air ingested by the engine comes solely from the hull.

Another aspect of the invention is directed to an induction system for an outboard motor having an engine. The system includes an enclosure disposed outside of the outboard motor and within a hull of a watercraft. The system further includes a first duct portion that has a first inlet in flow communication with the enclosure and a first outlet in flow communication with the outboard motor. The system further includes a second duct portion disposed within the outboard motor and has a second inlet. The second inlet is in flow communication with the first outlet of the first duct portion. The second duct routes air between the first outlet and the engine such that air ingested by the engine comes solely from inside the hull.

An additional aspect of the invention is directed to an outboard motor. The outboard motor includes a cowling and an engine within the cowling. The outboard motor further includes a duct passing through the cowling and that has an inlet and an outlet. The inlet receives ambient air. The outlet is in flow communication with the engine so as to form a closed air path from outside the cowling to the engine.

The systems and methods of the invention have several features, no single one of which is solely responsible for its desirable attributes. Without limiting the scope of the invention as expressed by the claims, its more prominent features have been discussed briefly above. After considering this discussion, and particularly after reading the section entitled "Detailed Description of the Preferred Embodiments," one will understand how the features of the system and methods provide several advantages over conventional induction systems.

BRIEF DESCRIPTION OF THE DRAWING

These and other features, aspects and advantages of the present invention will now be described in connection with preferred embodiment of the invention, in reference to the accompanying drawing. The illustrated embodiment, however, is merely an example and is not intended to limit the invention. The following is a brief description of the drawing.

DETAILED DESCRIPTION OF THE PREFERRED EMBODIMENTS

Figure 1:
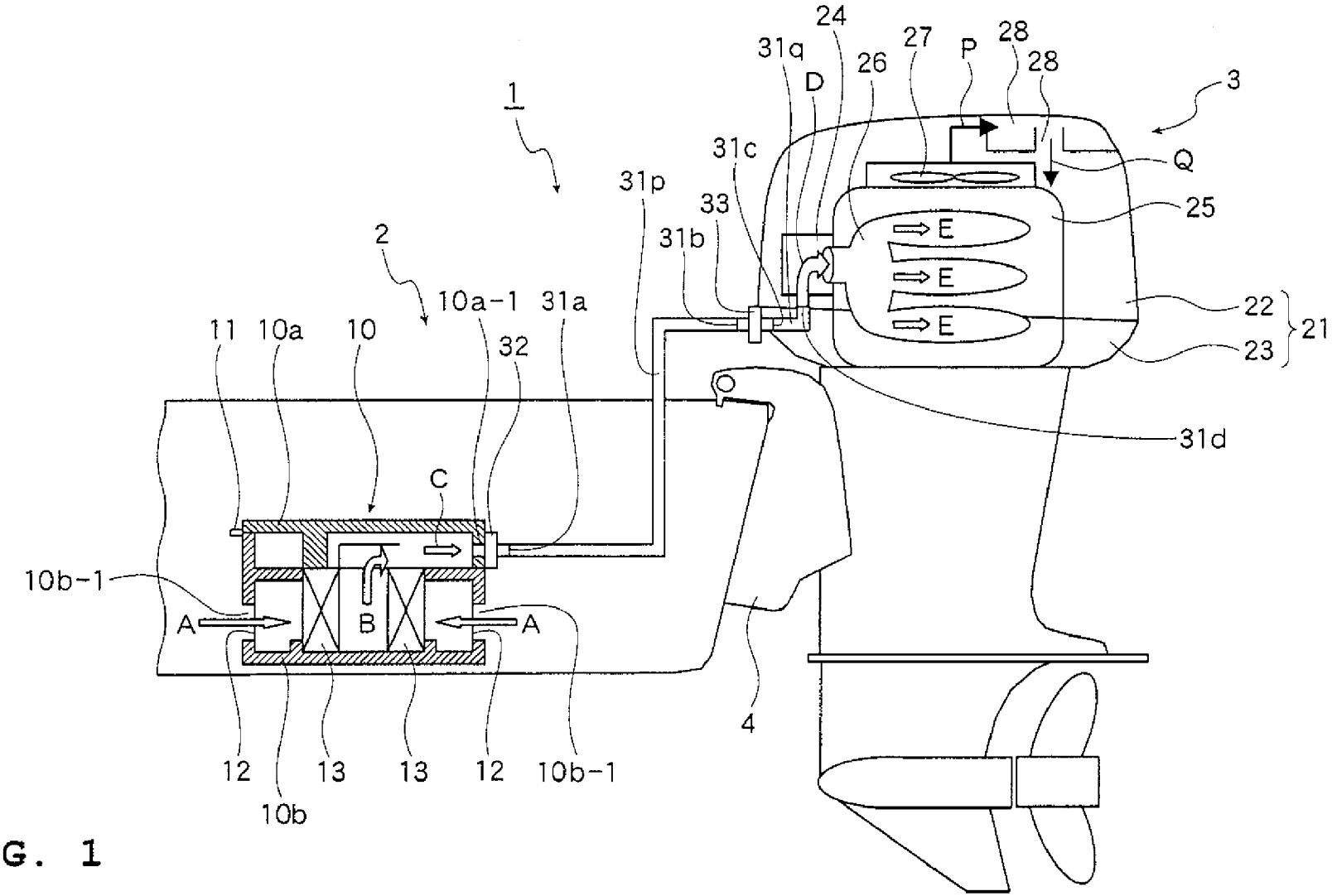
FIG. 1 is a schematic view of a watercraft having an induction system configured in accordance with a preferred embodiment of the present invention.

The following detailed description is now directed to certain specific embodiments of the invention. In this description, reference is made to the drawing wherein like parts are designated with like numerals throughout the description and the drawing.

FIG. 1 is a schematic view of a watercraft 1 having an induction system configured in accordance with a preferred embodiment of the present invention. The watercraft 1 includes a hull 2 and an outboard motor 3. The outboard motor 3 is mounted to the hull 2 by a bracket 4 and includes an engine 25.

The induction system routes air to the engine 25. As described in detail below, a duct routes air from inside the hull 2 to the induction system. A fuel system includes a fuel introducing device which provides fuel into the induction system. The fuel introducing device may be, for example, a carburetor, throttle body, one or more fuel injector(s), or other structure that adds fuel to the intake air. For example, the induction system may include a carburetor 24 as shown in FIG. 1 and an air intake enclosure 10 located upstream of the carburetor 24. Alternatively, the induction system may include one or more fuel injectors to introduce fuel into the induction system, into the engine cylinder(s) or into both. Accordingly, the downstream end of the duct may terminate at the carburetor 24 as illustrated in FIG. 1 or at another location within the induction system depending on the type of induction system employed with the engine 25.

The fuel introducing device either mixes fuel with or delivers fuel into the induction system so as to provide a mixture of air and fuel to the cylinders of the engine 25. Preferably, the air ingested by the engine 25 comes solely from inside the hull 2 and forms a closed air path between the hull 2 and the engine 25. Alternatively, air from within the outboard motor 3 is introduced into the induction system in addition to the air coming from the hull 2.

The air intake enclosure 10 is preferably disposed in the hull 2. The air intake enclosure 10 may include a body 10*b* and a cover or lid 10*a*. Ambient air enters the air intake enclosure 10 through one or more openings 10*b*-1 in and exits through an opening 10*a*-1. The air exiting the opening 10*a*-1 enters a duct via a coupler 32. The duct may be a unitary duct or multiple connected ducts. The duct illustrated in FIG. 1 includes an outer duct section 31*p* connected to an inner duct section 31*q* via an outboard side coupler 33.

In the illustrated embodiment, the openings 10*b*-1 for ambient air are disposed on the front and rear of the body 10*b*. However, the location and number of openings are not so limited. For example, the air intake enclosure 10 may include a single opening 110*b*-1 that extends along two or more side surfaces of the body 10*b*. A plurality of openings 10*b*-1 can be formed in the body 10*b* and spaced from each other. The number and configuration of the opening(s) may be selected depending on the structure of the hull 2.

The air intake enclosure 10 may include one or more blocking nets 12 and one or more water-repellant filters 13. The nets 12 are preferable disposed in the openings 10*b*-1 and filter foreign substances from the ambient air entering the enclosure 10. The water-repellant filters 13 may be disposed downstream of the nets 12. The filters 13 remove water and moisture from the air by inhibit water or moisture from passing therethrough while allowing air to pass therethrough. Accordingly, foreign substances and/or moisture are inhibited from passing through the enclosure 10 so as to avoid a decrease in engine 25 output caused by foreign substances reaching the engine 25. The water-repellant filters 13 may have a cylindrical and hollow shape.

The lid 10*a* is movable between an open position and a closed position relative to the body 10*b*. A coupling device, such as a hinge 11, couples the body 10*b* and the lid 10*a*. Preferably, the water-repellant filters 13 may be removed and replaced when the lid 10*a* is in the open position.

The outboard motor 3 includes a cowling 21. The cowling 21 may include a top cowling member 22 and a bottom cowling member 23. The cowling 21 houses the engine 25 and the fuel introducing device.

In the illustrated embodiment, the air and fuel are mixed within a carburetor 24 before entering an intake manifold 26. The air/fuel mixture is then routed to the combustion chambers of the engine 25.

Because the interior of the cowling 21 is a completely closed space, the air within the cowling 21 is convectively heated by the engine 25. A ventilating fan 27 may be disposed above the engine 25 to cool the engine 25. The ventilating fan 27 can be a flywheel-unified-type fan having blades unitarily attached to a flywheel. Alternatively, the ventilating fan 27 can be an electric fan controlled in accordance with an engine condition, such as temperature.

The cowling 21 includes a ventilating passage P 28. The passage 28 circulates the sir in the cowling 21 and improves the convection efficiency of transferring heat from the engine 25. The ventilating fan 27 may be configured to turn on and off as well as operate at different speeds to maintain a maximum preset temperature of the engine 25. By routing the intake air to the carburetor 24 separately from the air being used to cool the engine 25, the intake air is not heated. By not heating the intake air, the density of the intake air does not decrease which can decrease the output of the engine 25.

The ventilating fan 27 may continue to operate for a preset period of time after the engine 25 stops. The durability of the engine 25 is improved by cooling the engine 25 after the engine 25 has stopped.

The enclosure 10 connects to the fuel introducing device via a duct. The duct illustrated in FIG. 1 includes an outer duct section 31*p* connected to an inner duct section 31*q* via an outboard side coupler 33. The outer duct section 31*p* is external to the motor 3. The inner duct section 31*q* is disposed within the motor 3. The inner duct section 31*q* may extend between an outer surface of the cowling 21, for example the bottom cowling member 23, and an inside location of the fuel introducing device. The outer duct section 31*p*and the inner duct section 31*q* communicate with each other through the outboard side coupler 33. The one or both of the inner and outer sections 31*p*, 31*q* may be made of a flexible material so as to allow the outboard motor 3 to move (i.e. pivot, rotate, lift and the like) relative to the hull 2.

The outer duct section 31*p* has a first coupling port 31*a* or "air inlet port" and a second coupling port 31*b*. The first coupling port 31*a* is disposed at one end of the outer duct section 31*p* and connects to the coupler 32 the coupler 32 may be attached to the lid 10*a* or a surface of the body 10*b*. The second coupling port 31*b* is disposed at the other end of the outer duct section 31*p* and connects to a coupler 33. In the illustrated embodiment, the coupler 33 is attached to the bottom cowling 23.

The inner duct section 31*q* has a third coupling port 31*c* and a fourth coupling port 31*d*. The third coupling port 31*c* is disposed at one end of the of the inner duct section 31*q* and connects to the coupler 33. The third coupling port 31*e* provides an opening through the cowling 21. A fourth coupling port 31*d* or "air passing port" is disposed at the other end of the inner duct section 31*q*. The fourth coupling port 31*d* connects to the fuel introducing device.

A method of operating a watercraft 1 having the induction system described above will now be described. The method of operation includes a state where air enters the openings 10*b*-1 and concludes with the air being introduced into the engine 25. Preferably, the induction system provides a closed air path from inside the hull 2 to the induction system such that the air ingested by the engine 25 comes solely from the hull 2. Alternatively, air from within the cowling 21 is introduced into the induction system in addition to the air coming from the hull 2.

When the engine 25 starts, air enters the front and back of the enclosure 10 through the openings 10*b*-1 in a direction indicated by arrows A. The entering air is filtered of foreign substances by the blocking nets 12. The filtered air flows through the water-repellant filters 13 to remove moisture from the air. The air then continues through the enclosure 10 as indicated by arrow B. The order may be reversed in that the filters 13 may be located upstream of the nets 12 so that the air passes through the filters 13 before passing through the nets 12.

The enclosure 10 need not include both the filters 13 and nets 12. For example, one of the filters 13 and nets 12 may be located in the enclosure 10 with the other being located upstream or downstream of the enclosure 10. Further, the nets 12 and filters 13 may be combined to form a unitary structure.

As indicated by arrow C, the filtered, dry air enters the outer duct section 31*p* and flows through the inner duct section 31*q* before entering the carburetor 24. The air passes through the first coupling port 31*a* at one end of the outer duct section 31*p*. The outer duct section 31*p* routes the air to the side of the outboard motor 3. The inner duct section 31*q* routes the air entering the cowling 21 to the outboard motor 3. The fourth coupling port 31*d* at the end of the inner duct section 31*q* connects to the carburetor 24, for example a throttle body.

The carburetor 24 mixes the air with fuel. The air/fuel mixture is introduced into the intake manifolds 26 as indicated by the arrow D. The air is further introduced into the combustion chambers, which are not shown, to be burned, as indicated by arrow E.

The ventilating fan 27 blows warm air generated by the engine 25 toward the top surface of the top cowling member 22. The air then circulates through the ventilating passage 28 within the completely closed space of the cowling 21 as indicated by arrows P and Q, i.e., from arrow P to arrow Q. Of course the air could be routed along a different path within the cowling 21.

The air entering the outer duct section 31*p* is introduced to the carburetor 24 through the inner duct section 31*q*. Because one end of the outer duct section 31*p* is in the hull 2, little moisture, if at all, is mixed with the air passing through the duct and introduced into the engine 25. Also, because the air taken through the first coupling port 31*a* is directly introduced into the carburetor 24 without circulating the air within the cowling 21 of the outboard motor 3, the temperature of the air introduced into the combustion chambers in the cylinders does not substantially increase. The chance that moisture is mixed with the air introduced into the engine 25 is reduced. Also, the mixing of the air with the fuel can be completed before the air could be substantially warmed by heat from the engine 25 which improves the output efficiency of the engine 25.

The enclosure 10 is preferably detachable from the hull 2 and disposed on the upstream side of the fist coupling port 31 a of the outer duct section 31*p*. The opening 10*a*-1 in the enclosure 10 is coupled with the first coupling port 31*a* via the coupler 32. The openings 10*b*-1 in the enclosure 10 receive ambient air. The enclosure 10 routes the ambient air through the interior of the enclosure 10 and to the first coupling port 31*a*. An operator may select on which side of the hull 2 to attach the enclosure 10. The outer duct section 31*p* can be routed along the selected side of the hull 2. By preventing water from entering the air intake enclosure 10, the introduction of water into the engine 25 can be avoided.

The water-repellent filters 13 allow air to pass therethrough while preventing water from passing therethrough. Preferably, the air entering through the openings 10*b*-1 passes through the water-repellant filter 13 before reaching the first coupling port 31*a*. Thus, air entering the openings 10*b*-1 is introduced into the engine 25 after the water-repellant filter 13 removes moisture. The output of the engine 25 does not appreciably decrease due to the ambient air containing moisture when operating on fresh water or containing moisture and salt when operating on the sea.

The foreign substance blocking nets 12 block foreign substances from entering the air intake enclosure 10. Thus, the foreign substance blocking nets 12 remove foreign substances from the air entering through the openings 10*b*-1 before the air reaches the engine 25.

The lid 10*a* is movable between the open position and the closed position relative to the body 10*b*. The water-repellent filters 13 disposed in the enclosure 10 are preferably removable when the lid 10*a* is moved to the open position. Therefore, maintenance or replacement of the water-repellant filters 13 is facilitated.

The duct includes the inner duct section 31*q* positioned in the outboard motor 3 and the outer duct section 31*p* positioned outside of the outboard motor 3. The inner duct section 31*q* and the outer duct section 31*p* are coupled with each other through the outboard motor side coupler 33 in the cowling 21. The second coupling port 31*b* of the outer duct section 31*p* is preferably detachably connected to the outboard motor side coupler 33. The outer duct section 31*p* thus can be easily detached or attached to the outboard motor 3. The coupling port 31*b* of the outer duct section 31*p* is detachably connected to the coupler 33 and allows the duct to be easily detached or attached to the outboard motor 3.

In embodiments having a top cowling member 22 and a bottom cowling member 23, the engine 25 or other components may be serviced by removing the top cowling member 22 without removing the outer duct section 31*p*.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Fr example, the internal space of the cowling 21 need no be completely closed. Alternatively, the cowling 21 can have one or more inlet and outlet ports to improve the ventilation efficient of the ventilating fan 27.

In addition, while a number of variations of the invention have been shown and described in detail, other modifications, which are within the scope of this invention will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combine with or substituted for one another in order to form varying modes of the disclosed invention. Thus, it is intended that the scope of the present invention herein disclosed should not be limited by the particular disclosed embodiments described above, but should be determined only by a fair reading of the claims.

What is claimed is:

1. A watercraft comprising:

a hull;

an outboard motor mounted to the hull and having a cowling, the cowling housing an engine and an induction system, the cowling defining a completely closed space around the engine such that cooling air within the closed space is convectively heated by the engine;

a duct passing through the cowling and having an inlet and an outlet, the inlet being disposed within the hull and the outlet being connected to the induction system such that air ingested by the engine comes solely from the hull;

a fan disposed within the cowling and arranged with respect to the engine so as to route engine the cooling air exiting the fan in a first direction and thereby circulate the cooling air within the completely closed space; and a ventilating passage disposed within the cowling and being arranged with respect to the fan so as to route the engine cooling air exiting the fan in a second direction toward the engine so as to transfer thermal energy from the engine, the second direction being opposite to the first direction, wherein the engine cooling air is separate from the air inducted by the engine.

2. The watercraft according to claim 1 further comprising an air intake housing disposed within the hull and connected to the inlet, the air intake housing having an opening to receive air, the air intake housing routing air between the opening and the inlet.

3. The watercraft according to claim 2 further comprising a coupling between the air intake housing and the inlet of the duct.

4. The watercraft according to claim 2 further comprising a filter, the filter removing moisture from the air before the air reaches the inlet of the duct.

5. The watercraft according to claim 2 further comprising a net, the net filtering foreign substances from the air before the air reaches the inlet of the duct.

6. The watercraft according to claim 2, wherein the air intake housing comprises a body and a lid, the lid being movable between an open position and a closed position.

7. The watercraft according to claim 6 further comprising a filter, the filter being removable when the lid is in the open position and being secured when the lid is in the closed position.

8. The watercraft according to claim 1, wherein the duct includes an inner duct portion, an outer duct portion, and a coupler having a first end and a second end, the inner duct portion being disposed in the outboard motor and coupled to the first end, the outer duct portion being disposed outside of the outboard motor and coupled to the second end, wherein the first end is disposed in the cowling and the second end is disposed outside the cowling.

9. The watercraft according to claim 8, wherein the outer duct portion is detachable from the coupler.

10. The watercraft according to claim 9, wherein the cowling comprises a lower portion and an upper portion, and wherein the coupler is disposed in the lower cowling.

11. The watercraft according to claim 1, wherein the fan is a flywheel-unified-type ventilating fan.

12. The watercraft according to claim 11, wherein the fan has blades attached to a flywheel.

13. The watercraft according to claim 1, wherein the fan is operated at least in part based on a temperature of the engine.

14. The watercraft according to claim 1, wherein the fan operates for a predetermined time after the engine stops.

15. An induction and cooling system for an outboard motor having an engine within a cowling, the cowling defining a completely closed space around the engine such that engine cooling air within the closed space is convectively heated by the engine, the induction and cooling system comprising:

an enclosure disposed outside of the outboard motor and within a hull of a watercraft;

a first duct portion having a first inlet in flow communication with the enclosure and a first outlet in flow communication with the outboard motor;

a second duct portion disposed within the outboard motor and having a second inlet, the second inlet being in flow communication with the first outlet of the first duct portion, the second duct routing air between the first outlet and the engine such that air ingested by the engine comes solely from inside the hull;

a fan configured to be disposed within the cowling and arranged with respect to the engine so as to route the engine cooling air exiting the fan in a first direction; and a ventilating passage disposed within the cowling and being arranged with respect to the fan so as to route the engine cooling air exiting the fan in a second direction toward the engine so as to transfer thermal energy from the engine, the second direction being opposite to the first direction, wherein the engine cooling air is separate from the air inducted by the engine.

16. An outboard motor comprising:

a cowling defining a completely closed space around the engine such that engine cooling air within the closed space is convectively heated by the engine;

an engine within the cowling;

a duct passing through the cowling and having an inlet and an outlet, the inlet receiving ambient air and the outlet being in flow communication with the engine so as to form a closed air path from outside the cowling to the engine and separated from the closed space around the engine;

a fan disposed within the cowling and arranged with respect to the engine so as to route the engine cooling air exiting the fan in a first direction; and a ventilating passage disposed within the cowling and being arranged with respect to the fan so as to route the engine cooling air exiting the fan in a second direction toward the engine so as to transfer thermal energy from the engine, the second direction being opposite to the first direction, wherein the engine cooling air is separate from the ambient air passing through the duct.

17. The outboard motor according to claim 16 further comprising an air box disposed outside the cowling and in flow communication with the inlet.

18. The outboard motor according to claim 16, wherein at least a first portion of the duct is disposed within the cowling and at least a second portion of the duct is disposed outside of the cowling.

19. The outboard motor according to claim 17 further comprising a filter, the filter removing moisture from the air passing through the air box.

* * * * *